United States Patent [19]

Knaack et al.

[11] 4,290,281

[45] Sep. 22, 1981

[54] LOCK SYSTEM

[75] Inventors: Howard L. Knaack; Kenneth F. Weger, Jr., both of Cary, Ill.

[73] Assignee: Knaack Manufacturing Company, Crystal Lake, Ill.

[21] Appl. No.: 153,841

[22] Filed: May 27, 1980

[51] Int. Cl.[3] ..... E05B 67/38

[52] U.S. Cl. ..... 70/54; 70/63; 70/78; 70/159

[58] Field of Search ..... 70/54–56, 70/63, 77–84, 159, 203, 416–417, DIG. 56; 292/11, 104, 148, 205, 281

[56] References Cited

U.S. PATENT DOCUMENTS

| | | | |
|---|---|---|---|
| 2,455,069 | 11/1948 | Launder | 70/77 |
| 2,825,218 | 3/1958 | O'Brien . | |
| 2,974,987 | 3/1961 | O'Brien . | |
| 3,334,933 | 8/1967 | Ehlers . | |
| 3,572,062 | 3/1971 | Beebe . | |
| 3,606,423 | 9/1972 | McCarthy . | |
| 3,727,438 | 4/1973 | Knaack . | |
| 3,751,948 | 8/1973 | Klein . | |
| 3,808,847 | 5/1974 | Vesely | 70/56 |
| 3,838,586 | 10/1974 | Tennison | 70/56 |
| 3,848,441 | 11/1974 | Quinley | 70/55 |
| 4,006,614 | 2/1977 | Decker | 70/63 |
| 4,106,315 | 8/1978 | Dohanyos . | |
| 4,122,693 | 10/1978 | Barr . | |
| 4,135,375 | 1/1979 | Voegeli | 70/77 |

FOREIGN PATENT DOCUMENTS

| | | |
|---|---|---|
| 64533 | 12/1946 | Denmark . |

*Primary Examiner*—Robert L. Wolfe

*Attorney, Agent, or Firm*—Wegner, Stellman, McCord, Wood & Dalton

[57] ABSTRACT

A lock system for a container, such as a tool box or a storage cabinet which is locked by a padlock. Structure within the container mounts the padlock within the container with only a key insertion end of the padlock body exposed for access thereto. A bracket holds the shackle against movement and the padlock body is supported for movement between locked and unlocked relation with the shackle. A pivoted lock bracket associated with a movable closure for the container is positionable within the shackle when the container is closed for movement into engagement with the shackle by the padlock body as the latter is advanced for locking of the padlock.

18 Claims, 9 Drawing Figures

LOCK SYSTEM

BACKGROUND OF THE INVENTION

There are various types of containers in which it is desirable to lock the container by use of a padlock. This invention pertains to the location of a padlock within a container whereby the padlock is not exposed to tampering, as by attempts to cut the padlock shackle or pry the shackle from the lock body.

Typical of containers with which the lock system may be used are tool boxes, used at construction sites and similar locations for storage of various tools as well as storage cabinets for storage of tools and material and which have one or more doors requiring tamper-proof locking.

Knaack U.S. Pat. No. 3,727,438, owned by the assignee of this application, shows a commercial type of exterior padlock protection system wherein a padlock is used to lock a tool box and with the padlock being protected from tampering.

McCarthy U.S. Pat. No. 3,606,423 shows a tool box with a padlock protection system wherein the padlock is substantially enclosed within an enclosure mounted on the exterior of the tool box.

In the structures of the foregoing patents, the padlock and the protective structure are mounted exteriorly of the tool box, resulting in protruding structure which makes it more difficult to properly package and protect the tool box for shipment. Additionally, when the tool box is open, the padlock is free for removal which facilitates theft of the padlock with the resultant requirement for obtaining another padlock in order to lock the tool box.

SUMMARY OF THE INVENTION

A primary object of the present invention is to provide a lock system, utilizing a padlock, wherein the padlock and associated structure are disposed within the container and with the padlock only having the key insertion end exposed to the exterior of the container whereby the padlock is not exposed for tampering by attempts to either cut the shackle or separate it from the padlock body when the container is closed.

More particularly, in one form of the invention, the container is a tool box having a body and a movable cover, with means within the tool box mounting the padlock inside the tool box and with the shackle captured against substantial movement and with the padlock body supported for movement and having a key insertion end exposed for access from outside the tool box, and a lock bracket on the movable cover positionable within the shackle when the cover is closed for interengagement with the shackle by the action of locking the padlock.

In the aforesaid embodiment of the invention, the lock bracket is pivotally mounted to the underside of the cover and is normally in an inclined position and has a locking notch along one edge thereof whereby, when the cover is closed, the lock bracket moves into a position between the legs of the shackle with the locking notch at the level of the shackle and, thereafter, advance of the padlock body moves the lock bracket to a generally vertical position to interengage the shackle and notch with said interengagement being maintained by the locked padlock.

In another embodiment of the invention, the container is a storage cabinet having one or more doors with an inwardly extending catch member on the inner side thereof, a movable member in the cabinet is engageable with the catch member to hold the door closed, and means are provided for locking the movable member against movement by means of a padlock including means within the cabinet mounting the padlock with the shackle captured against substantial movement, the padlock body is supported for movement and has a key insertion end thereof exposed for access from outside the cabinet, and a lock bracket movable with the movable member and positionable within the shackle when the door is held closed for capture by the padlock upon locking thereof.

In both embodiments of the invention, the padlock is mounted by means of structure which permanently captures the shackle in a position to permit placement of the pivoted lock bracket between the legs of the shackle and with the padlock body causing interengagement between the lock bracket and the shackle by movement of said body during locking of the padlock and with the interengagement between the shackle and lock bracket being maintained by the padlock body. With the interengagement between the lock bracket and the shackle, the padlock body is relatively free for movement whereby, upon insertion of a key and unlocking of the padlock, the padlock body can easily be retracted, or automatically retracted if the padlock includes suitable spring means for causing such retraction, because of no interlocking engagement between the lock bracket and the padlock body.

DESCRIPTION OF THE PREFERRED EMBODIMENTS

A first embodiment of the lock system is shown in FIGS. 1 to 6 in association with a tool box, generally indicated at 10. The tool box has a body 11 and a movable closure in the form of a cover 12 connected to the body by hinge means at the rear of the tool box and as shown at 15.

Figure 2:
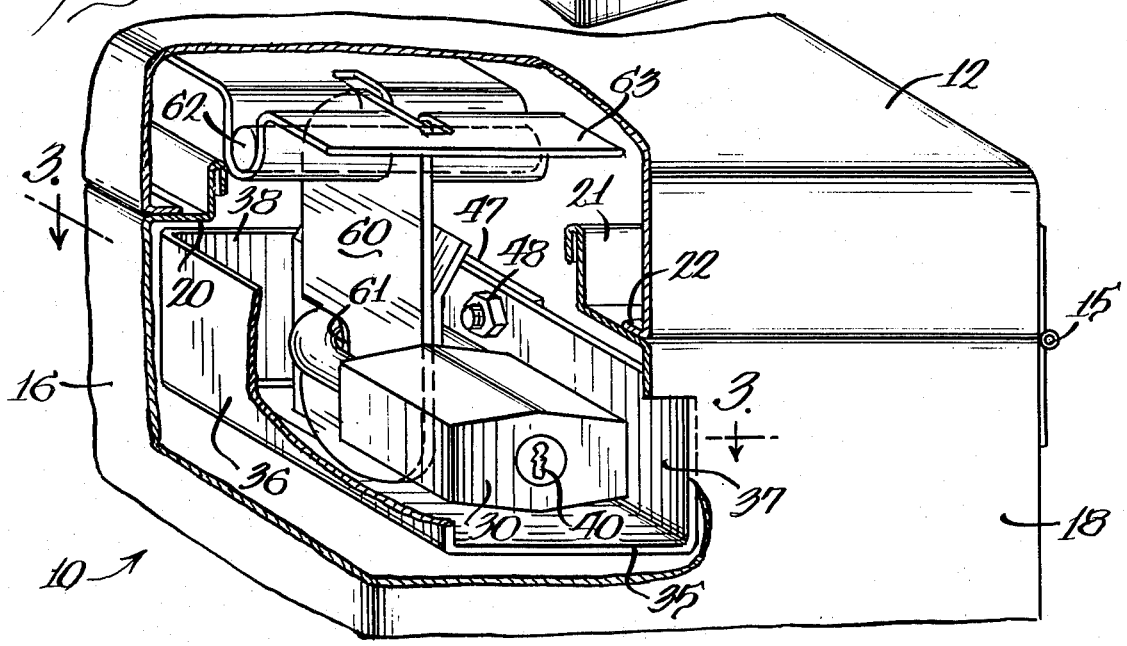
FIG. 2 is a fragmentary, perspective view on an enlarged scale of a corner of the locked tool box, with parts broken away.
Figure 3:
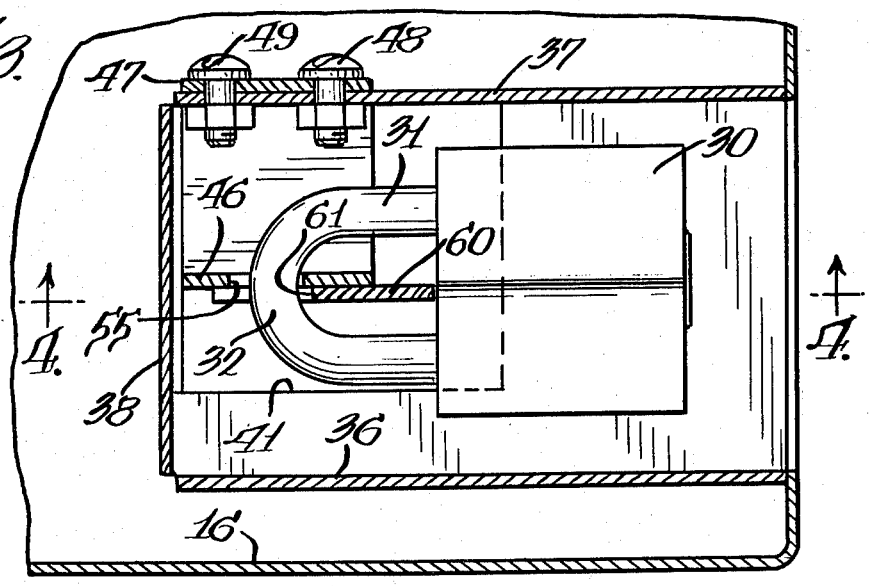
FIG. 3 is a plan section, taken generally along the line 3—3 in FIG. 2.
Figure 4:
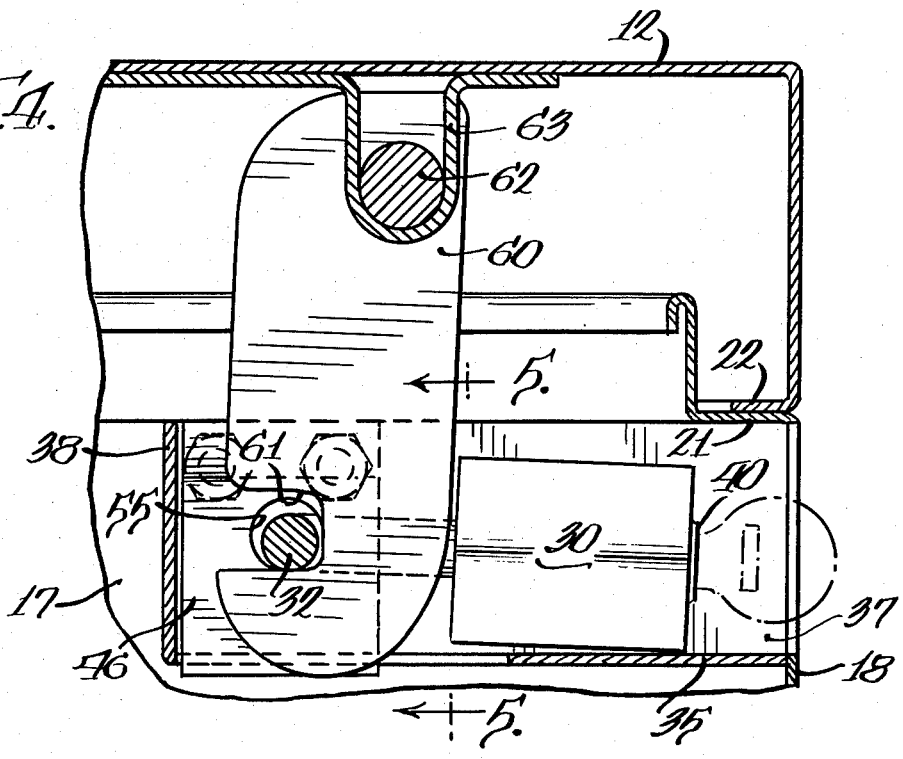
FIG. 4 is a vertical section, taken generally along the line 4—4 in FIG. 3.
Figure 5:
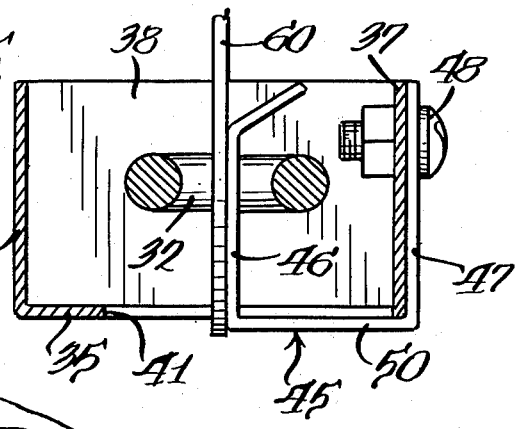
FIG. 5 is a fragmentary section, taken generally along the line 5—5 in FIG. 4 and with the tool box omitted.

The body 11 has front and rear walls 16 and 17 and end walls extending between the front and rear walls, with one of the end walls being shown at 18. The body walls each have an inturned flange at the upper edge, as shown in FIG. 2 at 20 and 21 for the front wall 16 and end wall 18, and with the downturned perimeter of the cover 12 having an inturned flange 22 which rests on the inturned wall flanges to form a closure for the tool box.

Figure 1:
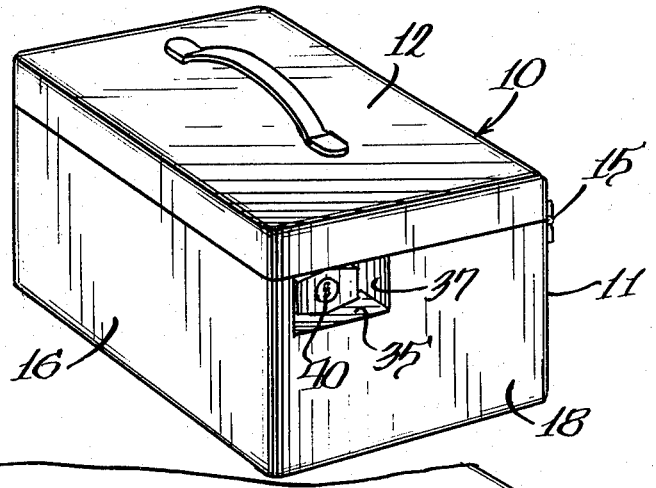
FIG. 1 is a perspective view of a container, such as a tool box, which is locked by the lock system.

The lock system associated with the tool box utilizes a padlock having a body 30 and a shackle 31 of a generally U-shape, with a pair of legs and an interconnecting bight 32. The padlock is positioned within the tool box by mounting structure including a member having a U-shaped channel cross section with a bottom 35, a pair of spaced-apart side walls 36 and 37 and a transverse end wall 38. This member is permanently secured within the tool box by having the bottom 35 and side walls 36 and 37 thereof welded at an end thereof to the interior of the end wall 18 of the tool box. As best seen in FIG. 1, the mounting member for the padlock has the interior channel thereof opening to the exterior of the tool box through an access opening in the end wall 18 thereof. With the tool box closed and locked, only the key-receiving end 40 of the padlock body is exposed for insertion of a key for unlocking of the padlock and for also manually advancing the padlock body into locked relation with the shackle 31. There is no access to the padlock for tampering by attempts to cut the shackle or separate it from the padlock body.

The bottom 35 of the mounting member has a generally rectangular opening with an edge 41 which permits positioning of a bracket 45 with a planar section 46 extending upwardly from the bottom wall 35. The bracket 45 is a generally U-shaped member, with a leg 47 thereof lying alongside the outer face of the member side wall 37 and secured thereto by locking means in the form of fasteners 48 and 49 which can be rivets or threaded members, as shown. Another leg of the bracket defines the planar section 46 and with the legs being interconnected by a connecting section 50 of the bracket 45. The planar section 46 has an opening 55 which loosely captures the shackle of the padlock by having the bight 32 thereof within the opening. As seen particularly in FIG. 3, the side walls 36 and 37 of the mounting member are spaced sufficiently close to each other to prevent movement of the unlocked padlock in a manner which can free the shackle 31 from its captured relation with the bracket 45. Initial assembly is accomplished by associating the padlock shackle with the bracket and, thereafter, moving the padlock and bracket up through the rectangular opening in the bottom 35 to an operative position and bringing the bracket leg 47 into position and, thereafter, attaching the bracket by use of the fasteners 48 and 49.

Figure 6:
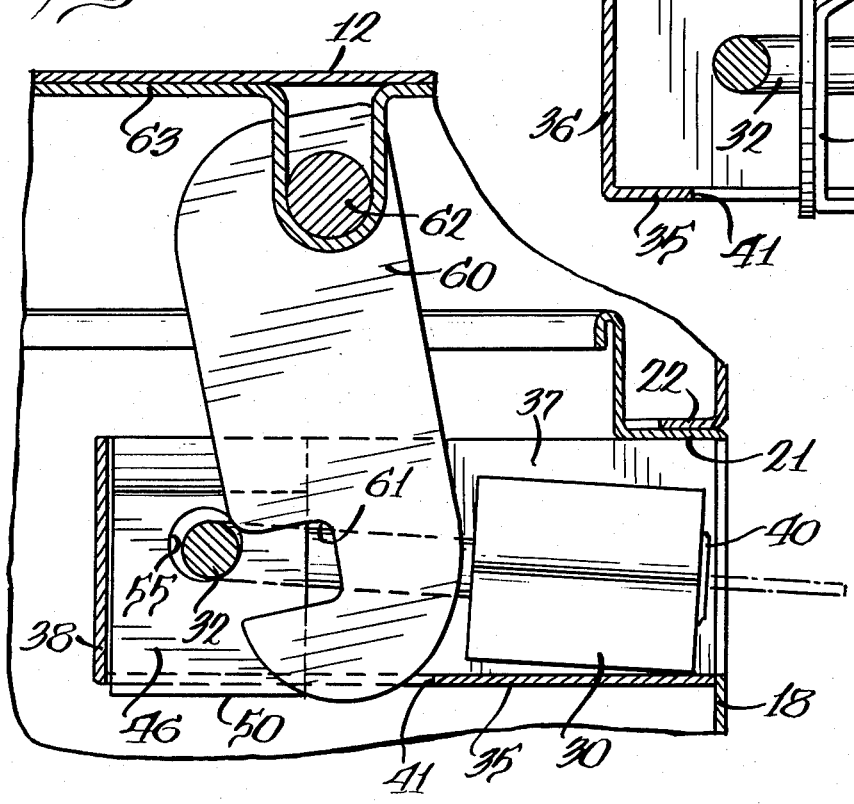
FIG. 6 is a view, similar to FIG. 4, showing the lock system unlocked.

A lock bracket 60 is mounted on the underside of the cover 12 in depending relation thereto and is in the form of a planar member having a locking notch 61 along an edge thereof for coaction with the bight 32 of the padlock shackle. The coaction therebetween is shown particularly in FIGS. 2 to 4. The lock bracket is pivotally-mounted by means of a rod 62 extending from opposite sides thereof and which is rotatably mounted within a bracket 63 secured to the underside of the cover 12, as by welding. The opening in lock bracket 60 which receives rod 62 is offset from the center of gravity of the lock bracket whereby the lock bracket normally will take an inclined position, as shown in FIG. 6. With the tool box closed, as shown in FIG. 6, the lock bracket 60 is in a position wherein the lower end thereof is disposed within the legs of the shackle 31 and the locking notch 61 is generally at the level of the shackle bight 32. Also, the padlock body 30 is in a position to have the key-receiving end 40 thereof closely adjacent the end wall 18 of the tool box. The padlock body 40 is advanced by pushing against the end thereof to engage an edge of the lock bracket 60 and pivot the lock bracket in a clockwise direction, as viewed in FIG. 6, from the position shown therein to the position shown in FIG. 4 wherein the lock bracket and shackle are interengaged. In this position, the padlock is locked and the body thereof maintains the aforesaid interengagement whereby it is not possible to open the tool box.

The lock system is unlocked by use of a key and either manual retraction of the padlock body 30 or retraction thereof by spring means associated with the padlock to return the parts to the position shown in FIG. 6. The lock bracket has freely moved to the inclined position to permit lifting of the cover 12 to open the tool box. The padlock body has only edge-to-edge contact with the lock bracket 60 whereby the lock body can readily move to the retracted position shown in FIG. 6.

Figure 7:
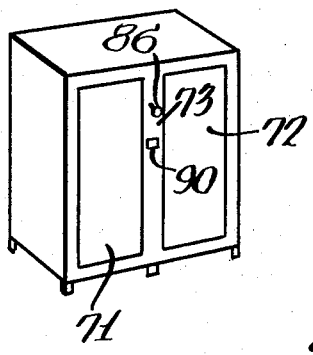
FIG. 7 is a perspective view of a storage cabinet embodying the invention.
Figure 8:
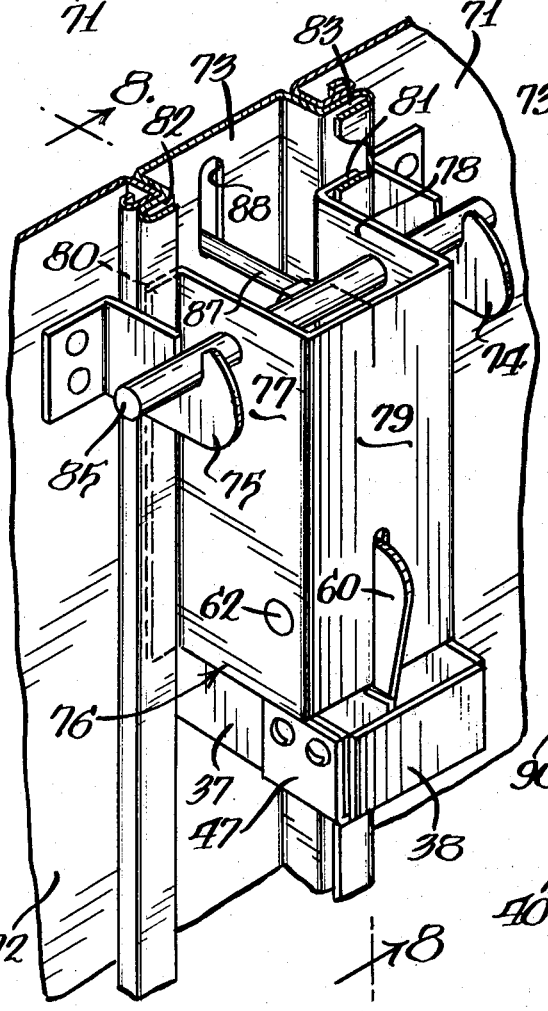
FIG. 8 is a fragmentary, perspective view of the storage cabinet of FIG. 7 on an enlarged scale and looking toward the inner face of a pair of cabinet doors.

Another embodiment of the lock system in association with a storage cabinet is shown in FIGS. 7 and 8. The storage cabinet, indicated generally at 70, has a pair of doors 71 and 72, with a central stile 73 therebetween formed integrally with the cabinet structure. Each door has an inwardly extending notched catch member secured thereto, as shown at 74 and 75, respectively. A slide member, indicated generally at 76 has a pair of spaced-apart panels 77 and 78 interconnected by a panel 79. The slide member is movable vertically relative to the central stile 73 by each of the panels 77 and 78 having respective out-turned flanges 80 and 81 which are slidably movable in a pair of U-shaped channels 82 and 83 formed on the inner side of the central stile 73. The slide member has a transversely extending bar 85 secured thereto, as by welding, and extending beyond the panels 77 and 78 for coaction with the notched catch members 74 and 75. The slide member is vertically movable manually by means of a handle 86 at the front of the central stile 73 and having a rod 87 extending through a vertical slot 88 in the central stile 73 for movement between the full line position and broken line position shown in FIG. 9. In the full line position, the bar 85 is in engagement with the catch members to maintain the doors 71 and 72 closed. When the bar 85 is lifted to the broken line position of FIG. 9, the doors are free for movement.

Figure 9:
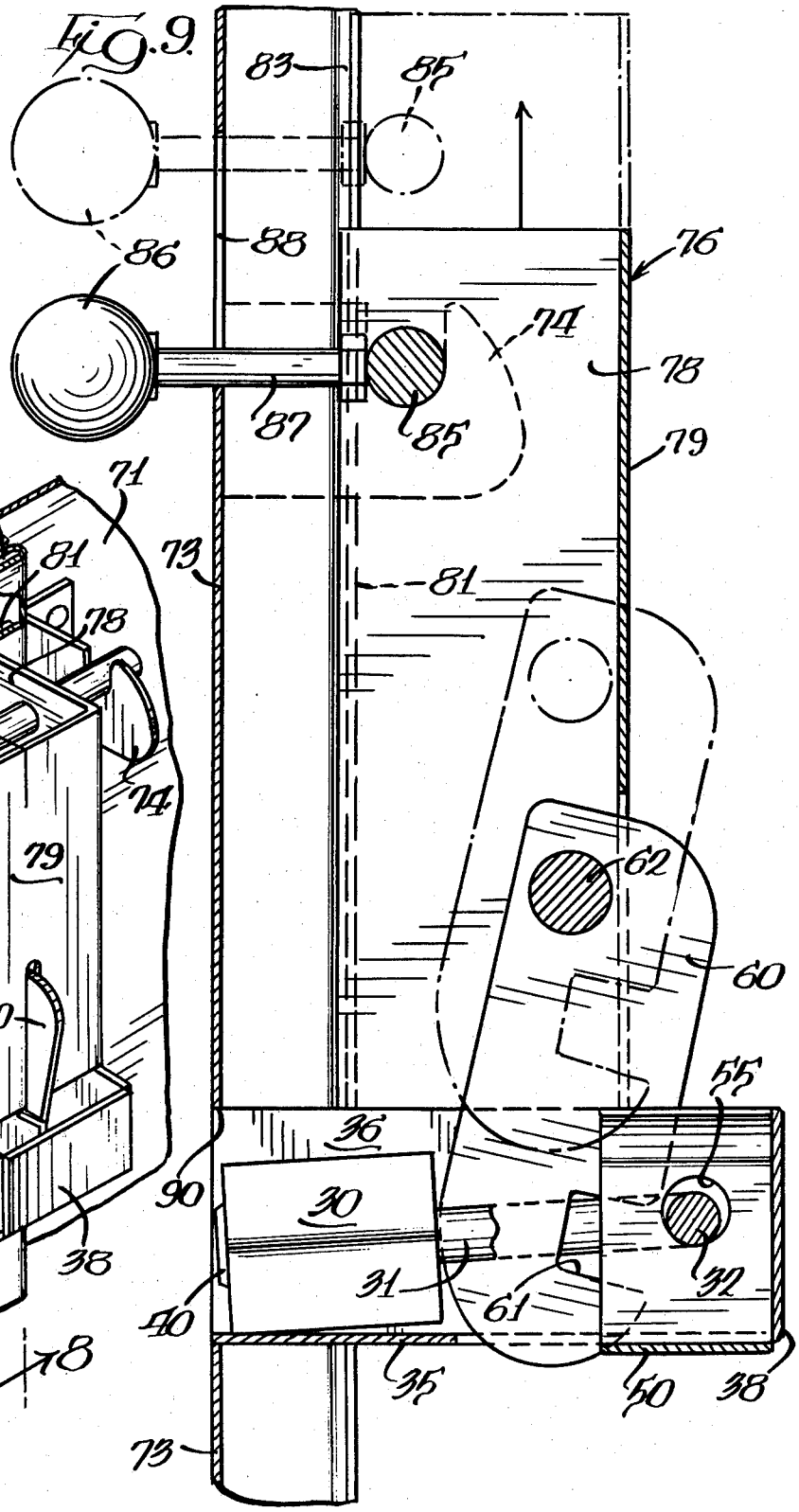
FIG. 9 is a vertical section, on a further enlarged scale, taken generally along the line 8—8 in FIG. 8 and showing the lock system unlocked and in a different operative position in broken line.

The doors are locked by the same lock system as used in the embodiment of FIGS. 1 to 6 and with similar parts being given the same reference numeral. In the embodiment of FIGS. 7–9, the open end of the mounting member is exposed to a front opening 90 of the central stile 73 and secured thereto, as by welding the bottom 35 and side walls 36 and 37 thereto.

The rod 62, which pivotally mounts the lock bracket 60, extends between the slide member panels 77 and 78 and is pivotally-mounted therein, whereby the lock bracket 60 can normally hang in an inclined position, as shown in FIG. 9, and move to the position within the padlock shackle and, thereafter, move into interengagement therewith, similarly as described in connection with the first embodiment. With this interengagement, the slide member 76 is held in the full line position of FIG. 9. whereby the bar 85 is held in engagement with the catch members 74 and 75 to prevent opening of the doors 71 and 72. The action of the lock system in moving between locked and unlocked positions is the same as that described in the previous embodiment.

With the structures disclosed herein, the padlock is positioned wholly within a container to be locked, such as a tool box or a storage cabinet, whereby the padlock is not exposed for tampering when the container is closed.

We claim:

1. A lock system for a tool box having a body and a movable cover and utilizing a padlock having a body and shackle comprising, means within the tool box mounting the padlock inside the tool box with the shackle captured against substantial movement to be inaccessible from outside the tool box, and the padlock body supported for movement and having a key insertion end thereof exposed for access from outside the tool box, and a lock bracket on the movable cover positionable in mechanically interlocked association with the shackle when the cover is closed for capture by the padlock upon locking thereof.

2. A lock system for a tool box having a body and a movable cover and utilizing a padlock having a body and shackle comprising, means within the tool box mounting the padlock inside the tool box with the shackle captured against substantial movement and the padlock body supported for movement and having a key insertion end thereof exposed for access from outside the tool box, and a lock bracket on the movable cover positionable within the shackle when the cover is closed for capture by the padlock upon locking thereof, said lock bracket being pivotally mounted on the underside of said cover and having a locking notch for interengagement with said shackle when the lock bracket is in a generally vertical position, and said lock bracket being normally urged to an inclined position closer to the padlock body with the locking notch out of engagement with the shackle whereby closing of the padlock by advance of the padlock body causes said interengagement.

3. A lock system as defined in claim 1 wherein said mounting means within the tool box includes a member secured to the tool box body with a bottom and a side wall and which communicates with an opening in a tool box body wall, and a planar section extending upwardly from said bottom at a distance from said side wall and with an opening to loosely capture the bight of the shackle, said padlock body being movably supported on said bottom.

4. A lock system for a cabinet having at least one door with an inwardly extending catch member on the inner side thereof, a movable member in the cabinet engageable with the catch member to hold the door closed, and means for locking said movable member against movement by a padlock having a body and a shackle comprising, means within the cabinet mounting the padlock therein with the shackle captured against substantial movement and the padlock body supported for movement and having a key insertion end thereof exposed for access from outside the cabinet, and a lock bracket movable with said movable member and positionable in mechanically interlocked association with the shackle when the door is held closed for capture by the padlock upon locking thereof.

5. A lock system as defined in claim 4 wherein there are a pair of said doors each having a catch member for engagement by said movable member.

6. A lock system as defined in claim 5 including a slide member movably mounted on the interior of the cabinet and carrying said movable member, means operable from outside the cabinet for moving said slide member, and said lock bracket being connected to said slide member.

7. A lock system as defined in claim 4 wherein said lock bracket is pivotally mounted and has a locking notch for interengagement with said shackle when the lock bracket is in a generally vertical position and said lock bracket being normally urged to an inclined position with the locking notch out of engagement with the shackle whereby closing of the padlock causes said padlock body to advance the lock bracket to cause said interengagement.

8. A lock system as defined in claim 4 wherein said mounting means includes a member secured to the cabinet with a bottom and a side wall and which communicates with an external opening of the cabinet, and a planar section extending upwardly from said bottom at a distance from said side wall and with an opening to loosely capture the bight of the shackle, said padlock body being movably supported on said bottom.

9. A lock system for a cabinet having a vertical central stile with a pair of doors positioned one to either side thereof and with each door having an inwardly extending catch member, a slide member mounted at the inner side of said stile for vertical movement and having a transversely extending bar engageable with said catch members, a handle at the front of the cabinet for moving said slide member, and means for locking said cabinet by a padlock having a body and a shackle comprising, means within the cabinet and mounted on the stile for holding the shackle in a generally horizontal plane and supporting the padlock body for movement and with a key insertion end thereof exposed to the front of the stile, and a lock bracket pivotally mounted to the slide member to normally depend therefrom in an inclined position and extend in mechanically interlocked association with the shackle when the slide member is positioned to hold the doors closed, and the lock bracket having a locking notch along an edge which is at the level of and opens toward the shackle whereby closing of the padlock causes the padlock body to advance the lock bracket into locked relation with the shackle.

10. A lock system for a container having a movable closure and which utilizes a padlock having a body and a shackle comprising, means for mounting the entire padlock within the container and with a key insertion end of the padlock body exposed for access thereto, said mounting means including means for holding the shackle against movement and supporting the padlock body for movement between locked and unlocked relation with the shackle, and a lock bracket associated with the movable closure and positionable in mechanically interlocked association with the shackle when the container is closed for capture by the padlock upon locking thereof.

11. A lock system for a container having a movable closure and which utilizes a padlock having a body and a shackle comprising, means for mounting the entire padlock within the container and with a key insertion end of the padlock body exposed for access thereto, said mounting means including means for holding the shackle against movement and supporting the padlock body for movement between locked and unlocked relation with the shackle, and a lock bracket associated with the movable closure and positionable within the shackle when the container is closed for capture by the padlock upon locking thereof, said lock bracket being pivotally mounted and having a locking notch positionable at the level of said shackle, and said lock bracket having a normal position inclined toward the padlock body with the locking notch out of engagement with the shackle, whereby advancement of the padlock body to lock the padlock moves the lock bracket to interengage the shackle and the lock bracket.

12. A lock system as defined in claim 11 wherein said mounting means includes a member secured to the interior of the container and having a bottom and a side wall with a planar section extending upwardly from said bottom and at a distance from said side wall and having an opening to hold the shackle.

13. A lock system as defined in claim 10 wherein said means comprises means for permanently retaining the shackle within the container for preventing loss of the padlock.

14. A lock system as defined in claim 10 wherein said container includes an outer wall defining an access opening, and said means positions said padlock with the key insertion end spaced substantially inwardly of said wall for access through said access opening.

15. A lock system as defined in claim 10 wherein said shackle defines a bight portion inwardmost of said key insertion end of said body, and said lock bracket has interlocked association with said bight portion.

16. A lock system as defined in claim 10 wherein said means for holding the shackle comprises a wall member having a through opening for receiving a lock shackle having any one of a substantial range of cross-sectional sizes.

17. A lock system as defined in claim 10 wherein said lock bracket defines an outwardly narrowing distal end receivable through the space defined by said shackle and body.

18. A lock system as defined in claim 10 wherein said lock bracket defines a rounded distal end receivable through the space defined by said shoulder and body.

* * * * *